US008864920B2

(12) United States Patent
Yamasaki et al.

(10) Patent No.: US 8,864,920 B2
(45) Date of Patent: Oct. 21, 2014

(54) HIGH STRENGTH WIRE ROD EXCELLENT IN DRAWABILITY AND METHOD OF PRODUCING SAME

(75) Inventors: Shingo Yamasaki, Kitakyushu (JP); Arata Iso, Kitakyushu (JP); Seiki Nishida, Kitakyushu (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 1460 days.

(21) Appl. No.: 11/994,078

(22) PCT Filed: Jun. 29, 2006

(86) PCT No.: PCT/JP2006/313026

§ 371 (c)(1), (2), (4) Date: Dec. 27, 2007

(87) PCT Pub. No.: WO2007/001057

PCT Pub. Date: Jan. 4, 2007

(65) Prior Publication Data

US 2009/0229711 A1 Sep. 17, 2009

(30) Foreign Application Priority Data

Jun. 29, 2005 (JP) ..... 2005-190259

(51) Int. Cl.

| | |
|---|---|
| ***C21D 9/52*** | (2006.01) |
| ***C22C 38/00*** | (2006.01) |
| ***C21D 11/00*** | (2006.01) |

(52) U.S. Cl.
USPC ..... 148/505; 148/330

(58) Field of Classification Search
USPC ..... 148/505, 330
See application file for complete search history.

(56) References Cited

U.S. PATENT DOCUMENTS

| | | | | |
|---|---|---|---|---|
| 5,211,772 | A | 5/1993 | Ashida et al. | |
| 6,322,641 | B1 | 11/2001 | Makii et al. | |
| 2003/0066575 | A1 * | 4/2003 | Nagao et al. | 148/320 |
| 2005/0087270 | A1 | 4/2005 | Nagao et al. | |

FOREIGN PATENT DOCUMENTS

| | | | |
|---|---|---|---|
| EP | 0 169 587 | 1/1986 | |
| EP | 1577410 | 9/2005 | |
| JP | 04-371549 | 12/1992 | |
| JP | 11-315347 | * 11/1999 | C22C 38/00 |
| JP | 11-315349 | 11/1999 | |
| JP | 2001-131697 | 5/2001 | |
| JP | 2003-328077 | 11/2003 | |
| JP | 2004-137597 | 5/2004 | |
| JP | 2044-137597 | 5/2004 | |
| JP | 2005-126765 | 5/2005 | |
| WO | WO 2004/029315 | 4/2004 | |

OTHER PUBLICATIONS

English Abstract and English Machine Translation of JP 11-315347 (Nov. 1999).*

Supplementary European, Search Report for associated European Patent Application No. 06767643.7, Mar. 10, 2009.

* cited by examiner

*Primary Examiner* — Jessee Roe

(74) *Attorney, Agent, or Firm* — Birch, Stewart, Kolasch & Birch, LLP

(57) ABSTRACT

A high strength wire rod in which an area fraction of pro-eutectoid ferrite is 3% or less and an area fraction of pearlite structure is 90% or more, being obtained by subjecting a hard steel wire rod having specified composition to a molten salt patenting treatment directly after hot-rolling or after performing re-austenitization subsequent to hot-rolling.

9 Claims, 2 Drawing Sheets

HIGH STRENGTH WIRE ROD EXCELLENT IN DRAWABILITY AND METHOD OF PRODUCING SAME

TECHNICAL FIELD

The present invention relates to a high strength hot-rolled wire rod excellent in drawability which is drawn and used for PC steel wires, galvanized stranded steel wires, spring steel wires, suspension bridge cables and the like. The invention also relates to a method of producing the wire rod and to a steel wire obtained by drawing the wire rod.

Priority is claimed on Japanese Patent Application No. 2005-190259, filed Jun. 29, 2005, the content of which is incorporated herein by reference.

BACKGROUND ART

In general, strength of conventional steel wires, for example bridge wires, has not exceeded the upper limit of 1600 MPa. In accordance with recent trend for building large bridges, a demand for high strength wires has increased. Such a high strength is also demanded for other steel wires such as PC steel wires.

In general, to provide high strength wires, high carbon hard wires are produced by subjecting hot-rolled wire rods to a patenting treatment, as required, and thereafter the wire rods are drawn, thereby obtaining steel wires having a predetermined diameter. By such a treatment, steel wires are required to have a strength of 1600 MPa or more and a sufficient ductility which is, for example, evaluated on the basis of a reduction of area after breaking.

In order to satisfy the above-described demands, attempts have been made to increase the drawing workability of the high carbon wire rod by controlling segregations or microstructures or by adding a particular element.

A reduction of area of patenting wire rods depends on a grain size of austenite. Specifically, the reduction of area can be improved by refining the grain size of austenite. Thus, attempts have been made to decrease the austenite grain size by using nitrides or carbides of Nb, Ti, B and the like as pinning particles.

A wire rod has been suggested in which as a chemical composition, one or more elements selected from the group consisting of 0.01 to 0.1 wt % of Nb, 0.05 to 0.1 wt % of Zr and 0.02 to 0.5 wt % of Mo, in mass percent, are added to a high carbon wire rod (e.g., Patent Document 1: Japanese Patent No. 2609387).

Another wire rod has been suggested in which NbC is contained in a high carbon wire rod to refine a grain size of austenite (e.g., Patent Document 2: Japanese Unexamined Patent Application, First Publication No. 2001-131697),

DISCLOSURE OF THE INVENTION

Problems to be Solved by the Invention

The wire rod described in Patent Document 1 contains the above-described chemical composition so as to have a component composition that increases the ductility of a steel wire. However, since each of the constituent elements added to the wire rod of Patent Document 1 is expensive, there is a possibility of increasing the production cost.

In the wire rod described in Patent Document 2, drawing workability is increased by using NbC as pinning particles. However, since each of the constituent elements added to the wire rod of Patent Document 2 is expensive, there is a possibility of increasing the production cost. In addition, Nb may form coarse carbides or nitrides and Ti may form coarse oxides. Therefore, there is a possibility that these coarse particles act as sources of breakage, thereby deteriorating the drawability of the wire rod.

On the other hand, it is confirmed that increasing the content of C and Si in components of steel is the most economical and effective expedient to increase the strength of a high carbon steel wire. However, in accordance with increasing Si content, ferrite generation is accelerated in the steel while cementite precipitation is suppressed. Even in the case of steel having a hyper-eutectoid composition in which the C content exceeds 0.8%, when the steel is cooled from an austenite region during a patenting treatment, pro-eutectoid ferrites tend to form along the austenite grain boundaries. Accordingly, after the patenting treatment, a reduction of area after breaking of a wire rod is lowered and the ductility thereof is deteriorated. Consequently, the frequency of breakage increases during a drawing process, thereby deteriorating the productivity or yield.

The invention has been made in view of the above-described circumstances, and an object of the present invention is to provide a high strength wire rod and a method of producing the same, which is excellent in drawability and can be produced with an inexpensive composition and with a high yield. Another object of the present invention is to provide a high strength steel wire excellent in drawability.

Expedients for Solving the Problem

As a result of thorough investigation, the present inventors have found that by including solid-solubilized B (B in a solid solution state) in an amount corresponding to the content of C and Si in austenite before subjecting the austenite to a patenting treatment, it is possible to provide a balanced driving force to the cementite precipitation and the ferrite precipitation and to thus obtain a high carbon pearlite wire rod having little amount of pro-eutectoid ferrite, thereby providing excellent workability based on excellent drawability as well as a high strength. The invention has been accomplished based on these findings.

The gist of the present invention is as follows:

A high strength wire rod according to a first aspect of the present invention is a high strength wire rod, containing, in mass %, C: 0.7 to 1.2%, Si: 0.6 to 1.5%, Mn: 0.1 to 1.0%, N: 0.001 to 0.006%, Al: 0.005 to 0.1%, further containing B in an amount of 0.0009 to 0.0060% where an amount of solid-solubilized B is 0.0002% or more, and the balance consisting of Fe and inevitable impurities, wherein, a tensile strength TS (MPa) of the steel is specified by the following formula (1), $$TS \geq [1000 \times C \text{ content } (\%) - 10 \times \text{wire-diameter (mm)} + 320] \quad (1),$$

an area fraction of a pro-eutectoid ferrite is 3% or less, and an area fraction of a pearlite structure is 90% or more.

A high strength wire rod according to a second aspect of the present invention is a high strength wire rod, containing, in mass %, C: 0.7 to 1.2%, Si: 0.6 to 1.5%, Mn: 0.1 to 1.0%, N: 0.001 to 0.006%, Ti: 0.005 to 0.1%, further containing B in an amount of 0.0009 to 0.0060%, and the balance of Fe and inevitable impurities, wherein an amount of solid-solubilized B is 0.0002% or more, a tensile strength TS (MPa) of the steel is specified by the following formula (1), $$TS \geq [1000 \times C \text{ content } (\%) - 10 \times \text{wire-diameter (mm)} + 320] \quad (1),$$

an area fraction of a pro-eutectoid ferrite is 3% or less, and an area fraction of a pearlite structure is 90% or more.

A high strength wire rod according to a third aspect of the present invention is a high strength wire rod excellent in drawability, which has the configuration as defined in the second aspect and further contains in mass %, Al: 0.1% or less.

A high strength wire rod according to a fourth aspect of the present invention is a high strength wire rod which has the configuration as defined in any one of the above-described second aspect and further contains one or more elements selected from the group consisting of, in mass %, Cr: 0.5% or less (not including 0%), Ni: 0.5% or less (not including 0%), Co: 0.5% or less (not including 0%), V: 0.5% or less (not including 0%), Cu: 0.2% or less (not including 0%), Mo: 0.2% or less (not including 0%), W: 0.2% or less (not including 0%), and Nb: 0.1% or less (not including 0%).

A fifth aspect of the present invention is a method of producing a high strength wire rod excellent in drawability, the method including: hot-rolling steel in a form of a billet having the chemical composition as defined in any one of the above described first to forth aspects, coiling the rolled rod steel at a temperature of Tr=800 to 950° C.; starting cooling of the steel within a period t1 (sec) after the cooling-coiling step subsequent to the hot-rolling; and cooling the steel while controlling a cooling rate to be 5° C./sec or more within a temperature range from a starting temperature of the cooling to 700° C., thereby performing patenting treatment of the steel, wherein the period t1 is selected from 40 seconds or from a period defined by the following formula (2):

$$t1=0.0008\times(Tr-815)^2+4\times(B\text{ content}-0.0003)/(N\text{ content}-Ti\text{ content}/3.41-B\text{ content}+0.0003) \quad (2),$$

where t1=40 seconds is selected as the period t1 to be used in the method if a value of 4×(B content−0.0003)/(N content−Ti content/3.41−B content+0.0003) is zero or smaller, or if a value of t1 as calculated by the formula (2) is greater than 40 seconds.

A sixth aspect of the present invention is a high strength wire having a chemical composition of high strength wire rod excellent in drawability according to any one of the above-described first to forth aspects, wherein a tensile strength is 1600 MPa or more, an area fraction of a pro-eutectoid ferrite is 3% or less, and an area fraction of a pearlite structure is 90% or more.

Effect of the Invention

The high strength wire rod excellent in drawability according to the present invention contains, in mass %, C: 0.7 to 1.2%, Si: 0.6 to 1.5%, Mn: 0.1 to 1.0%, N: 0.001 to 0.006%, Al: 0.005 to 0.1%, further contains B in an amount within a range from 0.0009 to 0.0060% where an amount of solid-solubilized B is 0.0002% or more, and the balance consisting of Fe and inevitable impurities, wherein the steel has a tensile strength TS (MPa) specified by the following formula: TS≥[1000×C content (%)−10×wire-diameter (mm)+320], an area fraction of pro-eutectoid ferrite is 3% or less, and an area fraction of a pearlite structure is 90% or more.

By controlling the amount of each component to satisfy the above-described relation and including solid-solubilized B in an amount corresponding to the content of C and Si in an austenite before subjecting the steel to a patenting treatment, it is possible to provide a balanced driving force to the cementite precipitation and the ferrite generation and thus to suppress formation of pro-eutectoid ferrites. Accordingly, it is possible to improve ductility and to prevent breakage during a drawing process, thereby improving the productivity or yield of the wire rod.

In addition, it is possible to obtain a hard steel wire having a structure mainly composed of pearlites wherein an average area fraction of pro-eutectoid ferrite is 3% or less. Accordingly, it is possible to improve performance when used for PC steel wires, galvanized steel wires, spring steel wires, suspension bridge cables.

BEST MODE FOR CARRYING OUT THE INVENTION

Figure 1:
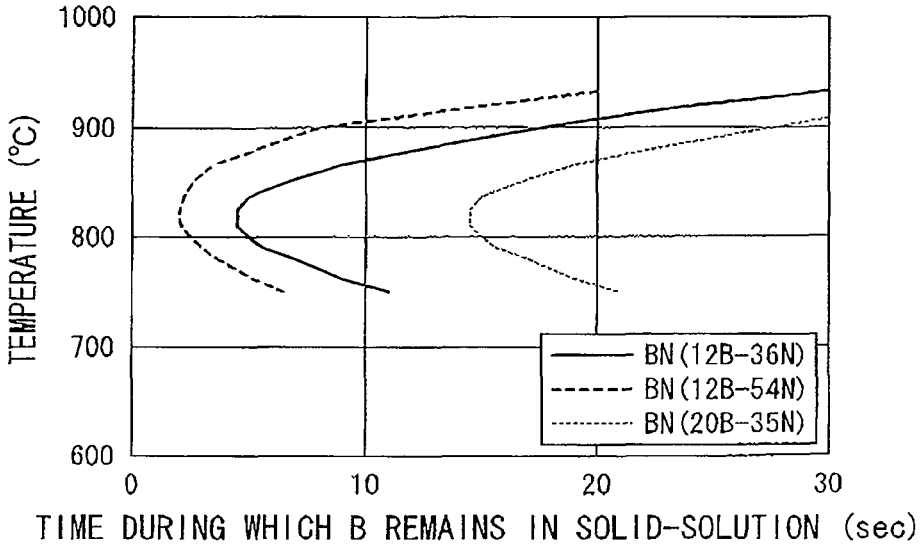
FIG. 1 shows examples of BN precipitation curves when the contents of B and N are different.

Hereinafter, embodiments of a high strength wire rod excellent in drawability according to the present invention will be described with respect to the accompanying drawings.

The embodiments will be described in detail for better understanding of the concept of the present invention and, unless explicitly stated otherwise, are not intended to limit the present invention.

A high strength wire rod according to this embodiment contains, in mass %, C: 0.7 to 1.2%, Si: 0.6 to 1.5%, Mn: 0.1 to 1.0%, N: 0.001 to 0.006%, Al: 0.005 to 0.1%, further contains B in an amount of 0.0009 to 0.0060%, where an amount of solid-solubilized B is 0.0002% or more, and the balance consists of Fe and inevitable impurities. A tensile strength TS (MPa) of the wire rod is specified by the following formula (1), $$TS\geq[1000\times C\text{ content }(\%)-10\times\text{wire-diameter (mm)}+320] \quad (1),$$

an area fraction of pro-eutectoid ferrite is 3% or less, and an area fraction of pearlite structure is 90% or more, Where the high strength wire rod excellent in drawability of the present embodiment contains, in mass %, 0.005 to 0.1% of Ti instead of the above-described content of Al, the wire rod may has a composition containing, in mass %, 0.0009 to 0.0060% of B wherein an amount of solid-solubilized B is 0.0002% or more, and the composition may further contains 0.1% or less of Al.

The high strength wire rod excellent in drawability according to the present embodiment may have a composition that contains, in addition to the above-described composition, one of more elements selected from the group consisting of, in mass %, Cr: 0.5% or less (not including 0%), Ni: 0.5% or less (not including 0%), Co: 0.5% or less (not including 0%), V: 0.5% or less (not including 0%), Cu: 0.2% or less (not including 0%), Mo: 0.2% or less (not including 0%), W: 0.2% or less (not including 0%), and Nb: 0.1% or less (not including 0%).

In the present invention, while limiting the component composition of a wire rod based on the below-described reasons, the component composition of the wire rod, the coiling temperature during a rolling process, a period from the end of coiling to the start of patenting, and the cooling rate during tire patenting treatment are limited, thereby suppressing the generation of pro-eutectoid ferrite during pearlite transformation, and providing the wire rod with excellent strength properties and drawing workability.

Component Composition:

Hereinafter, the reasons for limiting the component composition of the high strength wire rod excellent in drawability according to the present embodiment will be explained.

C: 0.7 to 1.2%

C (Carbon) is an element effective for increasing the strength of a wire rod. If the content of C in the wire rod is less than 0.7%, it is difficult to stably provide the high strength as defined by the formula (1) to a final product. Also, the pro-eutectoid ferrite generation is accelerated at the austenite grain boundaries, and it is thus difficult to obtain a uniform pearlite structure. Meanwhile, if the C content is too high, a pro-eutectoid cementite network may be formed at the austenite grain boundaries. Thus, breakage may easily occur during the drawing process and toughness and ductility of the ultra-fine wire rod obtained after a final drawing step remarkably deteriorate. For these reasons, the content of C in the wire rod is specified to be in the range from 0.7 to 1.2%, in mass %, Si: 0.6 to 1.5%

Si (Silicon) is an element effective for increasing the strength of a wire rod. Also, Si is a useful element as a deoxidizing agent and is a necessary element even in a production of a steel wire rod that does not contain Al. On the other hand, if the content of Si in the wire rod is too high, generation of pro-eutectoid ferrite is accelerated even in an eutectoid steel and the limit workability in the drawing process is degraded. In addition, the drawing by mechanical de-scaling (hereinafter referred to as MD) becomes difficult. For these reasons, the content of Si in the wire rod is specified to be in the range from 0.6 to 1.5%, in mass %.

Mn: 0.1 to 1.0%

Mn (Manganese), like Si, is a useful element as a deoxidizing agent. Mn is effective for improving hardenability and increasing the strength of a wire rod. Further, Mn has a function of fixing S in the steel as MnS and preventing hot brittleness. If the Mn content is less than 0.1 mass %, the above effects are rarely obtainable. On the other hand, since Mn is an element easy to segregate, if the Mn content is greater than 1.0 mass %, Mn segregates particularly in the central portion of the wire rod. In the segregated portion, martensites or bainites are generated and drawing workability is degraded. For these reasons, the content of Mn in the wire rod is specified to 0.1 to 1.0%, in mass %.

Al: 0.005 to 0.1%

Al (Aluminum) is effective as a deoxidizing agent. Further, Al has an effect of fixing N to inhibit aging, and an effect of increasing the content of solid-solubilized B. The Al content is preferably in the range of 0.005 to 0.1%, in mass %. If the content of Al in the wire rod is less than 0.005%, it is difficult to obtain the effect of fixing N. On the other hand, if the Al content is greater than 0.1%, a large amount of non-deformable alumina-based non-metallic inclusions are generated and lower the ductility and drawability of the steel wire.

In the case where the below-described Ti is added, by fixing of N by the Ti, it is possible to obtain the above-described effect without adding Al. Thus, it is not necessary to specify the lower limit of the Al content and the Al content may be 0%.

Ti: 0.005 to 0.1%

Ti (Titanium) is also effective as a deoxidizing agent. Since Ti is precipitated as TiN, Ti contributes to preventing coarsening of a grain size of austenite, and Ti is also effective for ensuring the amount of solid-solubilized B in austenite by fixing N. Therefore, Ti is a necessary element. If the Ti content is less than 0.005%, it is difficult to obtain the above effect. On the other hand, if the Ti content is greater than 0.1%, there is a possibility that coarse carbides may be generated in the austenite and degrade the drawability. For these reasons, the content of Ti in the wire rod is specified to 0.005 to 0.1%, in mass %.

N: 0.001 to 0.006%

N (Nitrogen) generates nitrides of Al, B or Ti in the steel and has a function of preventing coarsening of the grain size of austenite at the time of heating. Such an effect can be effectively obtained by adding 0.001% or more of N. However, if the N content is too high, too much nitride is generated and the amount of solid-solubilized B in the austenite is lowered. In addition, there is a possibility that solid-solubilized N accelerates the aging during the drawing process. For these reasons, the content of N in the wire rod is specified to 0.001 to 0.006%, in mass %.

B: 0.0009 to 0.0060%

Where B (Boron) is included in austenite in a solid solution state, B has an effect of suppressing generation of pro-eutectoid ferrite and accelerating precipitation of pro-eutectoid cementite by being concentrated in grain boundaries. Therefore, by adding B to the wire rod by an amount determined in consideration of its balance with the C and Si contents, it is possible to suppress the generation of pro-eutectoid ferrites. Since B forms nitrides, the B content should be determined in consideration of its balance with the N content in addition to the C and Si contents in order to ensure the amount of B in the solid solution state. If the B content is too high, there is a possibility that precipitation of pro-eutectoid cementite may be accelerated and coarse carbides such as $Fe_3(CB)_6$ may be produced in the austenite, thereby degrading the drawability. Through numerous experiments regarding their content relation, the present inventors have found that an optimum content of B in the wire rod be specified to 0.0009 to 0.0060%, in mass %. Since B needs to be present in the solid solution state before the patenting treatment, it is necessary to control the amount of solid-solubilized B in the wire rod after the rolling to be 0.0002% or more.

Although the contents of impurities P (Phosphorus) and S (Sulfur) are not particularly specified, the content of each of P and S is preferably specified to 0.02% or less, in mass % from the viewpoint of securing the ductility similar to the case of the conventional ultra-fine steel wire.

The high strength steel wire rod described in the present embodiment has the above-described components as a fundamental composition. However, one or more of the following selectively allowable additive elements may be positively included in the wire rod for the purpose of improving mechanical properties such as strength, toughness and ductility.

Cr: 0.5% or Less

Cr (Chromium) is an effective element for refining a spacing of pearlite lamella and improving the strength or drawing workability of a wire rod. In order to attain such an effect, Cr is preferably added in an amount of 0.1% or more. If the Cr content is too high, it may extend a transformation end time and excessively cooled structures such as martensites or bainites may be generated in the hot-rolled wire rod. Further, mechanical de-scalability is degraded. For these reasons, the upper limit of the Cr content is specified to 0.5%, in mass %.

Ni: 0.5% or Less

Ni (Nickel) is an element that does not contribute much to increasing the strength of the wire rod but is effective for increasing toughness of the drawn wire rod. In order to attain such an effect, Ni is preferably added in an amount of 0.1% or more. On the other hand, if too much Ni is added, the transformation end time (the time needed to complete the transformation) is extended. For this reason, the upper limit of the Ni content is specified to 0.5%, in mass %.

Co: 0.5% or Less

Co (Cobalt) is an effective element for suppressing the pro-eutectoid precipitation in the rolled materials. In order to attain such an effect, Co is preferably added in an amount of 0.1% or more. On the other hand, even if too much Co is added, the effect is saturated. Therefore, an excessive amount provides no advantage and there is a possibility of increasing the production cost. For these reasons, the upper limit of the Co content is specified to 0.5%, in mass %.

V: 0.5% or Less

By forming fine carbonitrides in ferrites, V (Vanadium) prevents coarsening of the grain size of austenite at the time of heating, and contributes to increasing the strength of the rolled materials. In order to attain such effects, V is preferably added in an amount of 0.05% or more. On the other hand, if too much V is added, an excessively large amount of carbonitrides are formed and the particle size of the carbonitrides also increases. For these reasons, the upper limit of the V content is specified to 0.5%, in mass %.

Cu: 0.2% or Less

Cu (Copper) has an effect of increasing the corrosion resistance of ultra-fine steel wire. In order to attain such an effect, Cu is preferably added in an amount of 0.1% or more. On the other hand, if too much Cu is added, Cu reacts with S to be segregated as CuS at the grain boundaries, thereby causing defects in the steel ingot or wire rod in the course of the wire rod production process. To prevent such an adverse effect, the upper limit of the Cu content is specified to 0.2%, in mass %.

Mo: 0.2% or Less

Mo (Molybdenum) has an effect of increasing the corrosion resistance of ultra-fine steel wire. In order to attain such an effect, Mo is preferably added in an amount of 0.1% or more. On the other hand, if too much Mo is added, the transformation end time is extended. For this reason, the upper limit of the Mo content is specified to 0.2%, in mass %.

W: 0.2% or Less

W (Tungsten) has an effect of increasing the corrosion resistance of ultra-fine steel wire. In order to attain such an effect, W is preferably added in an amount of 0.1% or more. On the other hand, if the W content is too high, the transformation end time is extended. For these reasons, the upper limit of the W content is specified to 0.2%, in mass %.

Nb: 0.1% or Less

Nb (Niobium) has an effect of increasing the corrosion resistance of ultra-fine steel wire. In order to attain such an effect, Nb is preferably added in an amount of 0.05% or more. On the other hand, if the Nb content is too high, the transformation end time is extended. For these reasons, the upper limit of the Nb content is specified to 0.1%, in mass %.

Structure of Wire Rod

According to various studies of the present inventors, it has become obvious that the pro-eutectoid ferrite that is generated at the grain boundaries of prior austenite of a wire rod has a particular influence on the drawing workability of a wire rod containing 0.6% or more of Si. It was confirmed that the occurrence of delamination can be suppressed by controlling the sectional area fraction of the pro-eutectoid ferrite to be 3% or less as in the case of the wire rod of the present embodiment. In the present embodiment, steel which satisfies the above-described requirements for the component composition is used as a wire rod material. After hot-rolling the steel, the steel is directly subjected to a patenting treatment. As a result, it is possible to obtain a wire rod or a steel wire, wherein pearlite constitutes a main structure and area fraction of pro-eutectoid ferrite is 3% or less.

Since the pearlite structure has a lamellar structure, it has a high strength and is most excellent in drawability. The area fraction of the pearlite structure is preferably equal to or greater than 90%. If the area fraction of the pearlite structure is less than 90%, the strength and ductility upon drawing of the wire rod is degraded.

Production Method

To obtain the wire rod having the structure and tensile strength as defined in the present embodiment using the steel having the component composition as defined in the present embodiment, it is necessary that B does not form carbides or nitrides during conveying the coiled steel for subjecting the steel to patenting treatment after rolling and coiling the steel and that the steel is cooled during the patenting treatment with a cooling rate not slower than a predetermined value. According to investigation of the present inventors, when a wire rod was heated at a temperature of 1050° C., rapidly cooled at a temperature of 750 to 950° C., held at that temperature for a predetermined period, and subjected to air blast cooling, as a result of examination of the structure and the amount of solid-solubilized B of the thus obtained wire rod, it has been found that a limit holding time for the wire rod to include 0.0002% or more of solid-solubilize B can be plotted by the C-shaped curve which is determined by the combination of the B and N contents as shown in FIG. 1, and that the time t1 can be specified by the following formula (2), $$t1=0.0008\times(Tr-815)^2+4\times(B\text{ content}-0.0003)/(N\text{ content}-Ti\text{ content}/3.41-B\text{ content}+0.0003) \quad (2)$$

In the formula (2), Tr is the coiling temperature. The formula (2) is valid in a range of compositions where the term, 4×(B content−0.0003)/(N content−Ti content/3.41−B content+0.0003) has a value greater than zero. If the term has a value equal to or smaller than zero, the holding time is not particularly limited. In the practical rolling process, it does not take longer than 40 seconds when measured from the end of coiling to the start of a patenting treatment. Therefore, the upper limit of the holding time is specified to 40 seconds. On the basis of the foregoing, it is necessary to water-cool the wire rod rolled at a temperature of 1050° C. or more, to coil the cooled wire rod at a temperature of 800° C. or more, preferably 850° C. or more and 950° C. or less, and to control the process time taken from the end of coiling to the start of the patenting treatment to be within the time as specified by the formula (2). If the temperature at the time of coiling is lower than 800° C., B is precipitated as carbides in the wire rod and thus B has an insufficient effect as solid-solubilized B for suppressing the formation of non-pearlite structures. If the temperature at the time of coiling is higher than 950° C., the γ grain size becomes coarse and thus the reduction of area of the wire rod is degraded.

After the wire rod is coiled, the patenting treatment is performed. It is necessary to perform the patenting treatment of the wire rod while controlling the cooling rate in a temperature range from the start temperature of cooling to 700° C. to be equal to or greater than 5° C./sec using a cooling method such as air-blast cooling or the like. If the cooling rate is less than 5° C./sec, it is difficult to obtain the predetermined strength.

With the above-described patenting treatment, it is possible to suppress the area fraction of the pro-eutectoid ferrite to 3% or less and to ensure a tensile strength (unit: MPa) not lower than a value specified by the following formula (1):

$$[1000\times C \text{ content } (\%)-10\times\text{wire-diameter (mm)}+320]\ \text{MPa}$$

By controlling the diameter of the wire rod so as to be in the range of 5.5 to 18 mm in the present embodiment, it is possible to stably obtain excellent drawability and high strength.

EXAMPLES

Method of Producing Sample Steel

Using a continuous casting plant, sample steels having the component compositions, in mass % of each element, as specified in Tables 1 and 3 were continuously cast into cast slabs having a sectional size of 300×500 mm. The cast slabs were bloomed into billets having a diagonal length of 122 mm in angular cross section. Thereafter, each of the billets was rolled into a wire rod having a diameter as specified in Tables 2 and 4, coiled at a predetermined temperature, and subjected to a air-blast patenting (direct patenting: DP) treatment within a predetermined time after finishing the coiling. Thus, the high strength wire rods excellent in drawability (Inventive Steels 1 to 30) according to the present invention and the conventional wire rods (Comparative Steels 31 to 55) were produced. Production conditions for each wire rod are shown in Tables 2 and 4.

Evaluation Test Method

Solid-solubilized B

The amount of B present as a chemical compound in electrolytically extracted residues of the patented wire rod was measured using curcumin-based absorption spectroscopy, and the amount of B in the solid solution state was calculated by subtracting the measured B amount from a total amount of B.

Area Fraction of Pro-eutectoid Ferrite Structure

The patented wire rod and the drawn wire rod were embedded and ground and thereafter subjected to chemical erosion using picric acid, and the area fraction of the pro-eutectoid ferrite in a section (L section) parallel to the longitudinal direction of the wire rod was determined based on SEM observation. The area fraction of the pro-eutectoid ferrite of the rolled wire rod was measured as follows. By incising and grinding the wire rod, the L section was exposed in a position corresponding to ±5% of the radius from the center of the wire rod. By image analysis, the area fraction of the pro-eutectoid ferrite with respect to a total area corresponding to wire-diameter in radial direction×twice the wire diameter in longitudinal direction. The thus measured area fraction was used as the area fraction of the pro-eutectoid ferrite.

The area fraction of the pearlite was measured as follows. In SEM observation, structure photographs with a magnification of 2000 were taken from each 5 views of 100×100 μm in areas on each of the surface layer of the L section, ¼D and ½D position of the wire rod, and area fraction of pearlite was determined as average area fraction measured by the image analysis. At that time, bainites or degenerate-pearlites having cementites dispersed in point sequence were excluded from the measurement. On the other hand, the area fraction of the pro-eutectoid ferrite of the drawn wire rod was measured as follows. By incising and grinding the wire rod, the L section was exposed in a position corresponding to ±5% of the radius from the center of the wire rod. By SEM observation, photographs with a magnification of 4000 were taken from each of 5 views of 40 μm in depth×40 μm in width in areas and an average area fraction of pro-eutectoid ferrite was measured by the image analysis. The measurement results showed that the area fraction of the pro-eutectoid ferrite was substantially the same before and after the drawing process was performed. Incidentally, when a decarburized layer was present on the surface layer, the totally decarburized portion as specified as 4 in JIS G 0558 was excluded from the measurement, Tensile Strength The tensile strength was measured three times and an average was calculated under conditions that a gauge length of 200 mm and a speed of 10 mm/min were used.

Tables 2 and 4 show the evaluation results of the strength of the patented wire rod, the area fraction of the pro-eutectoid ferrite (α), the area fraction of the pearlite, and the amount of the solid solution B (in mass %).

TABLE 1

| No. | | Element | | | | | | | | | | | | | | | | |
|---|---|---|---|---|---|---|---|---|---|---|---|---|---|---|---|---|---|---|
| | | C | Si | Mn | P | S | B | Al | Ti | N | Cr | Mo | Ni | Cu | V | Co | W | Nb |
| 1 | Inv. Steel | 0.70 | 0.60 | 0.45 | 0.019 | 0.025 | 0.0045 | 0.029 | 0.000 | 0.0025 | — | — | — | — | — | — | — | — |
| 2 | Inv. Steel | 0.80 | 1.50 | 0.7 | 0.015 | 0.013 | 0.0040 | 0.031 | 0.000 | 0.0024 | — | — | — | — | — | — | — | — |
| 3 | Inv. Steel | 0.92 | 0.60 | 0.7 | 0.019 | 0.025 | 0.0041 | 0.032 | 0.000 | 0.0034 | — | — | 0.10 | — | — | — | — | — |
| 4 | Inv. Steel | 0.92 | 0.80 | 0.5 | 0.025 | 0.020 | 0.0051 | 0.030 | 0.000 | 0.0040 | — | — | — | — | — | — | 0.10 | 0.10 |
| 5 | Inv. Steel | 0.82 | 0.90 | 0.7 | 0.025 | 0.020 | 0.0042 | 0.030 | 0.000 | 0.0025 | — | — | — | — | 0.20 | — | — | — |
| 6 | Inv. Steel | 0.87 | 1.00 | 0.5 | 0.008 | 0.007 | 0.0052 | 0.030 | 0.000 | 0.0050 | 0.20 | — | — | — | — | — | — | — |
| 7 | Inv. Steel | 0.97 | 0.95 | 0.6 | 0.008 | 0.007 | 0.0035 | 0.031 | 0.000 | 0.0020 | 0.20 | 0.20 | — | — | — | — | — | — |
| 8 | Inv. Steel | 1.20 | 1.20 | 0.5 | 0.010 | 0.009 | 0.0022 | 0.000 | 0.010 | 0.0050 | 0.20 | — | — | 0.10 | — | — | — | — |
| 9 | Inv. Steel | 0.90 | 0.90 | 0.8 | 0.010 | 0.009 | 0.0030 | 0.000 | 0.005 | 0.0030 | — | — | 0.10 | — | — | — | — | — |
| 10 | Inv. Steel | 0.87 | 1.00 | 0.4 | 0.015 | 0.013 | 0.0028 | 0.000 | 0.010 | 0.0025 | 0.20 | — | — | — | — | 0.30 | — | — |
| 11 | Inv. Steel | 1.12 | 1.00 | 0.3 | 0.015 | 0.013 | 0.0034 | 0.030 | 0.000 | 0.0025 | — | — | — | — | — | 0.30 | — | — |
| 12 | Inv. Steel | 0.72 | 1.00 | 0.5 | 0.015 | 0.013 | 0.0043 | 0.028 | 0.000 | 0.0025 | — | — | — | — | 0.20 | — | — | — |
| 13 | Inv. Steel | 0.92 | 0.60 | 0.5 | 0.025 | 0.020 | 0.0048 | 0.080 | 0.000 | 0.0040 | — | — | — | — | — | — | 0.10 | 0.10 |
| 14 | Inv. Steel | 0.82 | 0.80 | 0.5 | 0.025 | 0.020 | 0.0049 | 0.030 | 0.000 | 0.0035 | — | — | — | — | 0.20 | — | — | — |

TABLE 1-continued

| No. | | Element | | | | | | | | | | | | | | | | |
|---|---|---|---|---|---|---|---|---|---|---|---|---|---|---|---|---|---|---|
| | | C | Si | Mn | P | S | B | Al | Ti | N | Cr | Mo | Ni | Cu | V | Co | W | Nb |
| 15 | Inv. Steel | 0.87 | 1.20 | 0.5 | 0.008 | 0.007 | 0.0054 | 0.030 | 0.000 | 0.0045 | 0.20 | — | — | — | — | — | — | — |
| 31 | Comp. Steel | 0.70 | 0.40 | 0.6 | 0.008 | 0.007 | 0.0039 | 0.030 | 0.000 | 0.0020 | — | 0.20 | — | — | — | — | — | — |
| 32 | Comp. Steel | 1.20 | 1.20 | 0.5 | 0.010 | 0.009 | 0.0007 | 0.000 | 0.010 | 0.0050 | 0.20 | — | — | 0.10 | — | — | — | — |
| 33 | Comp. Steel | 0.90 | 0.90 | 0.8 | 0.010 | 0.009 | 0.0080 | 0.000 | 0.005 | 0.0030 | — | — | 0.10 | — | — | — | — | — |
| 34 | Comp. Steel | 0.87 | 1.60 | 0.4 | 0.015 | 0.013 | 0.0034 | 0.000 | 0.010 | 0.0025 | 0.20 | — | — | — | — | — | — | — |
| 35 | Comp. Steel | 1.30 | 1.00 | 0.3 | 0.015 | 0.013 | 0.0039 | 0.030 | 0.000 | 0.0025 | — | — | — | — | — | 0.30 | — | — |
| 36 | Comp. Steel | 0.92 | 0.61 | 1.5 | 0.015 | 0.013 | 0.0035 | 0.025 | 0.000 | 0.0025 | — | — | — | — | 0.20 | — | — | — |
| 37 | Comp. Steel | 0.92 | 0.80 | 0.5 | 0.025 | 0.020 | 0.0011 | 0.035 | 0.000 | 0.0040 | — | — | — | — | — | — | 0.10 | 0.10 |
| 38 | Comp. Steel | 0.82 | 0.80 | 0.5 | 0.025 | 0.020 | 0.0008 | 0.030 | 0.000 | 0.0035 | — | — | — | — | 0.20 | — | — | — |
| 39 | Comp. Steel | 0.80 | 0.60 | 0.45 | 0.019 | 0.025 | 0.0039 | 0.036 | 0.000 | 0.0025 | — | — | — | — | — | — | — | — |
| 40 | Comp. Steel | 0.80 | 0.61 | 0.45 | 0.019 | 0.025 | 0.0040 | 0.036 | 0.000 | 0.0025 | — | — | — | — | — | — | — | — |
| 41 | Comp. Steel | 0.87 | 1.20 | 0.5 | 0.008 | 0.007 | 0.0008 | 0.030 | 0.000 | 0.0045 | 0.20 | — | — | — | — | — | — | — |
| 42 | Comp. Steel | 0.70 | 1.50 | 0.5 | 0.008 | 0.007 | 0.0080 | 0.030 | 0.000 | 0.0060 | 0.20 | — | — | — | — | — | — | — |
| 43 | Comp. Steel | 1.20 | 0.40 | 0.5 | 0.008 | 0.007 | 0.0020 | 0.030 | 0.000 | 0.0010 | 0.20 | — | — | — | — | — | — | — |
| 44 | Comp. Steel | 1.20 | 0.60 | 0.5 | 0.008 | 0.007 | 0.0006 | 0.030 | 0.010 | 0.0010 | 0.20 | — | — | — | — | — | — | — |

TABLE 2

| No. | | DIAMETER OF ROLLED WIRE (mm) | COILING TEMP. (° C.) | PERIOD OF COILING-PATENTING (sec) | UPPER LIMIT OF PERIOD | PATENTING METHOD | COOLING RATE (° C./sec) |
|---|---|---|---|---|---|---|---|
| 1 | INVEN- | 5.5 | 900 | 8.4 | 40 | DP | 24 |
| 2 | TIVE | 18.0 | 900 | 11.7 | 40 | DP | 6 |
| 3 | STEEL | 5.5 | 910 | 8.4 | 40 | DP | 24 |
| 4 | | 8.0 | 880 | 9.1 | 40 | DP | 16 |
| 5 | | 12.5 | 950 | 10.5 | 40 | DP | 10 |
| 6 | | 13.5 | 910 | 10.5 | 40 | DP | 9 |
| 7 | | 9.0 | 890 | 9.1 | 40 | DP | 14 |
| 8 | | 10.0 | 860 | 10.5 | 40 | DP | 12 |
| 9 | | 5.5 | 900 | 8.4 | 40 | DP | 24 |
| 10 | | 12.5 | 910 | 11.7 | 40 | DP | 10 |
| 11 | | 15.0 | 905 | 11.7 | 40 | DP | 8 |
| 12 | | 12.0 | 920 | 10.5 | 40 | DP | 10 |
| 13 | | 6.0 | 900 | 8.4 | 40 | DP | 21 |
| 14 | | 9.0 | 900 | 9.1 | 40 | DP | 14 |
| 15 | | 14.5 | 905 | 11.7 | 40 | DP | 8 |
| 31 | COM- | 5.5 | 750 | 8.4 | 40 | DP | 24 |
| 32 | PARA- | 12.0 | 890 | 10.5 | 6 | DP | 10 |
| 33 | TIVE | 5.5 | 880 | 8.4 | 40 | DP | 24 |
| 34 | STEEL | 13.0 | 900 | 10.5 | 40 | DP | 9 |
| 35 | | 13.5 | 910 | 10.5 | 40 | DP | 8 |
| 36 | | 5.5 | 920 | 8.4 | 40 | DP | 24 |
| 37 | | 6.0 | 900 | 8.4 | 7.3 | DP | 22 |
| 38 | | 7.0 | 900 | 8.4 | 6.8 | DP | 19 |
| 39 | | 13.5 | 900 | 10.5 | 40 | AP | 3 |
| 40 | | 13.5 | 900 | 10.5 | 40 | AP | 2 |
| 41 | | 12.0 | 900 | 10.5 | 6.5 | DP | 10 |
| 42 | | 12.0 | 900 | 10.5 | 40 | DP | 10 |
| 43 | | 12.0 | 900 | 10.5 | 5.8 | DP | 10 |
| 44 | | 12.0 | 900 | 10.5 | — | DP | 10 |

| No. | | PATENTED WIRE STRENGTH (MPa) | TS THRESH-OLD (MPa) | REDUCTION OF AREA PATENTED WIRE ROD (%) | AREA FRACTION OF PRO-EUTEC-TOIDEα (%) | AREA FRACTION OF PEARLITE (%) | AMOUNT OF SOLID-SOLUTION B |
|---|---|---|---|---|---|---|---|
| 1 | INVEN- | 1170 | 965 | 52 | 2.5 | 95 | 0.0011 |
| 2 | TIVE | 1269 | 940 | 50 | 2.4 | 96 | 0.0005 |
| 3 | STEEL | 1284 | 1185 | 49 | 1.6 | 96 | 0.0009 |
| 4 | | 1354 | 1160 | 46 | 2.6 | 95 | 0.0008 |
| 5 | | 1208 | 1015 | 53 | 2.2 | 96 | 0.0013 |
| 6 | | 1268 | 1055 | 51 | 1.6 | 96 | 0.0004 |
| 7 | | 1417 | 1200 | 45 | 0.9 | 97 | 0.0005 |
| 8 | | 1450 | 1420 | 41 | 0.4 | 98 | 0.0013 |
| 9 | | 1394 | 1165 | 48 | 0.8 | 97 | 0.0011 |
| 10 | | 1278 | 1065 | 50 | 2.4 | 96 | 0.0023 |
| 11 | | 1460 | 1290 | 43 | 1.1 | 97 | 0.0004 |
| 12 | | 1138 | 920 | 52 | 2.7 | 95 | 0.0023 |
| 13 | | 1216 | 1180 | 53 | 2.1 | 96 | 0.0006 |

TABLE 2-continued

| | | | | | | | |
|---|---|---|---|---|---|---|---|
| 14 | | 1273 | 1050 | 51 | 1.9 | 96 | 0.0012 |
| 15 | | 1289 | 1045 | 49 | 1.1 | 97 | 0.0008 |
| 31 | COM- | 1066 | 965 | 47 | 3.3 | 96 | 0.0006 |
| 32 | PARA- | 1460 | 1400 | 30 | 4.2 | 88 | <0.0002 |
| 33 | TIVE | 1465 | 1165 | 38 | 0.9 | 94 | 0.0036 |
| 34 | STEEL | 1368 | 1060 | 39 | 6.3 | 82 | 0.0025 |
| 35 | | 1436 | 1485 | 29 | 0.6 | 92 | 0.0007 |
| 36 | | 1286 | 1185 | 41 | 2.1 | 89 | 0.0004 |
| 37 | | 1376 | 1180 | 38 | 4.2 | 83 | <0.0002 |
| 38 | | 1276 | 1070 | 41 | 4.6 | 72 | 0.0009 |
| 39 | | 921 | 985 | 52 | 0.8 | 93 | 0.0011 |
| 40 | | 931 | 985 | 52 | 0.8 | 97 | 0.0012 |
| 41 | | 1318 | 1070 | 40 | 4.2 | 82 | 0.0028 |
| 42 | | 1120 | 900 | 40 | 0.2 | 94 | 0.0031 |
| 43 | | 1512 | 1400 | 35 | 3.8 | 88 | <0.0002 |
| 44 | | 1530 | 1400 | 32 | 4.3 | 87 | — |

TABLE 3

| | | Element | | | | | | | | | | | | | | | | |
|---|---|---|---|---|---|---|---|---|---|---|---|---|---|---|---|---|---|---|
| No. | | C | Si | Mn | P | S | B | Al | Ti | N | Cr | Mo | Ni | Cu | V | Co | W | Nb |
| 16 | Inv. Steel | 0.70 | 0.80 | 0.45 | 0.019 | 0.025 | 0.0025 | 0.029 | 0.000 | 0.0025 | — | — | — | — | — | — | — | — |
| 17 | Inv. Steel | 0.80 | 0.62 | 0.7 | 0.015 | 0.013 | 0.0022 | 0.031 | 0.000 | 0.0024 | — | — | — | — | — | — | — | — |
| 18 | Inv. Steel | 0.92 | 0.60 | 0.7 | 0.019 | 0.025 | 0.0031 | 0.032 | 0.000 | 0.0052 | — | — | 0.10 | — | — | — | — | — |
| 19 | Inv. Steel | 0.87 | 0.90 | 0.75 | 0.008 | 0.005 | 0.0018 | 0.045 | 0.010 | 0.0045 | 0.03 | — | 0.03 | 0.03 | — | — | — | — |
| 20 | Inv. Steel | 0.85 | 0.90 | 0.75 | 0.008 | 0.005 | 0.0018 | 0.045 | 0.005 | 0.0035 | 0.01 | — | — | — | — | — | — | — |
| 21 | Inv. Steel | 0.87 | 1.10 | 0.5 | 0.008 | 0.007 | 0.0021 | 0.030 | 0.000 | 0.0033 | 0.20 | — | — | — | — | — | — | — |
| 22 | Inv. Steel | 0.97 | 0.95 | 0.6 | 0.008 | 0.007 | 0.0026 | 0.042 | 0.000 | 0.0036 | 0.20 | 0.20 | — | — | — | — | — | — |
| 23 | Inv. Steel | 1.10 | 0.80 | 0.5 | 0.010 | 0.009 | 0.0012 | 0.000 | 0.010 | 0.0045 | 0.20 | — | — | 0.10 | — | — | — | — |
| 24 | Inv. Steel | 0.90 | 0.90 | 0.8 | 0.010 | 0.009 | 0.0012 | 0.000 | 0.000 | 0.0030 | — | — | 0.10 | — | — | — | — | — |
| 25 | Inv. Steel | 0.87 | 1.10 | 0.5 | 0.008 | 0.007 | 0.0019 | 0.030 | 0.000 | 0.0033 | 0.01 | — | — | — | — | — | — | — |
| 26 | Inv. Steel | 0.85 | 0.90 | 0.75 | 0.008 | 0.005 | 0.0020 | 0.045 | 0.000 | 0.0032 | 0.20 | — | — | — | — | 0.30 | — | — |
| 27 | Inv. Steel | 0.72 | 1.50 | 0.5 | 0.015 | 0.013 | 0.0048 | 0.028 | 0.000 | 0.0055 | — | — | — | — | 0.20 | — | — | — |
| 28 | Inv. Steel | 0.72 | 1.45 | 0.5 | 0.015 | 0.013 | 0.0029 | 0.028 | 0.000 | 0.0021 | — | — | — | — | — | — | 0.10 | 0.10 |
| 29 | Inv. Steel | 0.82 | 0.80 | 0.5 | 0.025 | 0.020 | 0.0012 | 0.030 | 0.040 | 0.0051 | — | — | — | — | 0.20 | — | — | — |
| 30 | Inv. Steel | 0.87 | 1.20 | 0.5 | 0.008 | 0.007 | 0.0025 | 0.030 | 0.000 | 0.0045 | 0.20 | — | — | — | — | — | — | — |
| 45 | Comp. Steel | 0.70 | 0.60 | 0.6 | 0.008 | 0.007 | 0.0016 | 0.030 | 0.000 | 0.0020 | — | 0.20 | — | — | — | — | — | — |
| 46 | Comp. Steel | 0.90 | 0.90 | 0.8 | 0.010 | 0.009 | 0.0062 | 0.000 | 0.005 | 0.0060 | — | — | 0.10 | — | — | — | — | — |
| 47 | Comp. Steel | 0.87 | 1.60 | 0.4 | 0.015 | 0.013 | 0.0021 | 0.000 | 0.000 | 0.0036 | 0.20 | — | — | — | — | — | — | — |
| 48 | Comp. Steel | 0.92 | 0.62 | 1.5 | 0.015 | 0.013 | 0.0018 | 0.025 | 0.000 | 0.0025 | — | — | — | — | 0.20 | — | — | — |
| 49 | Comp. Steel | 0.92 | 0.80 | 0.5 | 0.025 | 0.020 | 0.0003 | 0.035 | 0.000 | 0.0040 | — | — | — | — | — | — | 0.10 | 0.10 |
| 50 | Comp. Steel | 0.70 | 1.60 | 0.5 | 0.008 | 0.007 | 0.0011 | 0.030 | 0.000 | 0.0060 | 0.20 | — | — | — | — | — | — | — |
| 51 | Comp. Steel | 1.10 | 0.60 | 0.5 | 0.008 | 0.007 | 0.0003 | 0.030 | 0.000 | 0.0028 | 0.20 | — | — | — | — | — | — | — |
| 52 | Comp. Steel | 0.70 | 1.50 | 0.5 | 0.008 | 0.007 | 0.0009 | 0.030 | 0.000 | 0.0026 | 0.20 | — | — | — | — | — | — | — |
| 53 | Comp. Steel | 0.87 | 0.90 | 0.75 | 0.008 | 0.005 | 0.0018 | 0.045 | 0.000 | 0.0035 | 0.03 | — | 0.30 | 0.30 | — | — | — | — |
| 54 | Comp. Steel | 0.87 | 1.10 | 0.5 | 0.008 | 0.007 | 0.0013 | 0.030 | 0.000 | 0.0033 | 0.20 | — | — | — | — | — | — | — |
| 55 | Comp. Steel | 1.20 | 0.80 | 0.5 | 0.008 | 0.007 | — | 0.001 | 0.000 | 0.0036 | 0.20 | — | — | — | — | — | — | — |

TABLE 4

| No. | | DIAMETER OF ROLLED WIRE (mm) | COILING TEMP. (° C.) | PERIOD OF COILING-PATENTING (sec) | UPPER LIMIT OF PERIOD | PATENTING METHOD | COOLING RATE (° C./sec) |
|---|---|---|---|---|---|---|---|
| 16 | INVEN- | 5.0 | 850 | 6.0 | 40 | DP | 24 |
| 17 | TIVE | 17.0 | 850 | 7.0 | 40 | DP | 6 |
| 18 | STEEL | 6.0 | 855 | 6.0 | 13.8 | DP | 23 |
| 19 | | 13.0 | 825 | 7.0 | 40 | DP | 12 |
| 20 | | 11.5 | 875 | 7.0 | 40 | DP | 13 |
| 21 | | 13.5 | 825 | 7.0 | 13.3 | DP | 9 |
| 22 | | 10.0 | 890 | 6.6 | 40 | DP | 14 |
| 23 | | 9.0 | 860 | 6.6 | 18.5 | DP | 16 |
| 24 | | 5.0 | 900 | 6.0 | 8.7 | DP | 24 |
| 25 | | 12.0 | 875 | 7.0 | 11.5 | DP | 10 |
| 26 | | 14.0 | 825 | 7.0 | 12 | DP | 9 |
| 27 | | 13.0 | 920 | 7.0 | 40 | DP | 11 |
| 28 | | 6.5 | 940 | 6.0 | 40 | DP | 22 |
| 29 | | 8.0 | 810 | 6.0 | 40 | DP | 14 |
| 30 | | 14.0 | 905 | 7.0 | 15.3 | DP | 9 |
| 45 | COM- | 8.3 | 750 | 8.4 | 40 | DP | 18 |
| 46 | PARA- | 5.5 | 880 | 8.4 | 40 | DP | 21 |
| 47 | TIVE | 13.0 | 900 | 10.5 | 15.3 | DP | 10 |

TABLE 4-continued

| | | | | | | | |
|---|---|---|---|---|---|---|---|
| 48 | STEEL | 5.5 | 920 | 8.4 | 30.6 | DP | 23 |
| 49 | | 6.0 | 850 | 8.4 | — | DP | 21 |
| 50 | | 7.0 | 825 | 8.4 | 1 | DP | 19 |
| 51 | | 10.0 | 900 | 7.8 | — | DP | 15 |
| 52 | | 12.0 | 820 | 10.5 | 1.95 | DP | 13 |
| 53 | | 12.0 | 825 | 10.5 | 6.2 | DP | 13 |
| 54 | | 13.5 | 825 | 10.5 | 3.1 | DP | 12 |
| 55 | | 12.5 | 900 | 10.5 | — | DP | 13 |

| No. | | PATENTED WIRE STRENGTH (MPa) | TS THRESH-OLD (MPa) | REDUCTION OF AREA PATENTED WIRE ROD (%) | AREA FRACTION OF PRO-EUTEC-TOIDEα (%) | AREA FRACTION OF PEARLITE (%) | AMOUNT OF SOLID-SOLUTION B |
|---|---|---|---|---|---|---|---|
| 16 | INVEN- | 1246 | 970 | 51 | 2.4 | 96 | 0.0002 |
| 17 | TIVE | 1211 | 950 | 51 | 1.6 | 96 | 0.0003 |
| 18 | STEEL | 1218 | 1180 | 50 | 2.6 | 95 | 0.0002 |
| 19 | | 1288 | 1060 | 46 | 2.2 | 96 | 0.0011 |
| 20 | | 1286 | 1055 | 50 | 1.6 | 96 | 0.0007 |
| 21 | | 1338 | 1055 | 47 | 0.9 | 97 | 0.0005 |
| 22 | | 1311 | 1190 | 47 | 0.4 | 98 | 0.0002 |
| 23 | | 1286 | 1330 | 47 | 0.8 | 97 | 0.0007 |
| 24 | | 1291 | 1170 | 49 | 2.4 | 96 | 0.0002 |
| 25 | | 1338 | 1070 | 47 | 1.1 | 97 | 0.0003 |
| 26 | | 1286 | 1030 | 48 | 2.7 | 95 | 0.0003 |
| 27 | | 1423 | 910 | 43 | 2.1 | 96 | 0.0004 |
| 28 | | 1411 | 975 | 46 | 1.9 | 92 | 0.0008 |
| 29 | | 1258 | 1060 | 49 | 1.3 | 93 | 0.0009 |
| 30 | | 1363 | 1050 | 45 | 1.2 | 94 | 0.0002 |
| 45 | COM- | 1196 | 937 | 42 | 1.6 | | 0.0004 |
| 46 | PARA- | 1291 | 1165 | 39 | 1.8 | | 0.002 |
| 47 | TIVE | 1463 | 1060 | 29 | 1.4 | | 0.0004 |
| 48 | STEEL | 1223 | 1185 | 41 | 1.3 | | 0.0003 |
| 49 | | 1268 | 1180 | 33 | 5.2 | | <0.0002 |
| 50 | | 1446 | 950 | 35 | 4.2 | | <0.0002 |
| 51 | | 1236 | 1320 | 30 | 5.2 | | <0.0002 |
| 52 | | 1421 | 900 | 36 | 4.2 | | <0.0002 |
| 53 | | 1288 | 1070 | 39 | 3.8 | | <0.0002 |
| 54 | | 1338 | 1055 | 38 | 4.6 | | <0.0002 |
| 55 | | 1296 | 1395 | 39 | 5.5 | | — |

In Table 1 and Table 2, numbers 1 to 15 correspond to the high strength wire rod according to the present invention (Inventive Steel) and numbers 31 to 44 correspond to the conventional wire rod (Comparative Steel).

Figure 2:
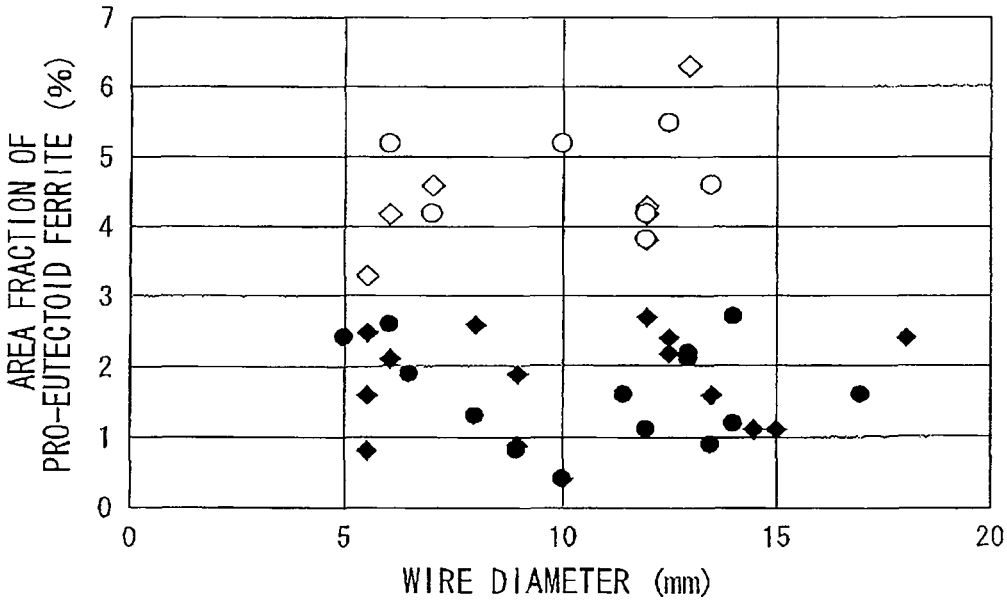
FIG. 2 is a graph showing a relation between a diameter of a wire rod and an area fraction of pro-eutectoid ferrite in a section extending from the surface of the wire rod to the central portion thereof for each of wire rods after patenting treatments. In high strength wire rods according to the present invention denoted by solid diamonds ♦ showing values in Table 2 and solid circles ● showing values in Table 4, each of the wire rod has an area fraction of pro-eutectoid ferrite of 3% or less regardless of the wire diameter. While, in each of the conventional wire rods of Comparative Example denoted by open diamonds ◇ showing values in Table 2 and open circles ○ showing values in Table 4, an area fraction of pro-eutectoid ferrite is greater than 3%.

FIG. 2 is a graph showing a relation between a diameter of a wire rod and an area fraction of pro-eutectoid ferrite in a section extending from the surface of the wire rod to the central portion thereof for each of wire rods after patenting treatments. The high strength wire rods of Table 2 according to the present invention which are denoted by a solid diamond symbol (♦) stably had an area fraction of pro-eutectoid ferrite of 3% or less regardless of the wire diameter. On the other hand, in each of the conventional high strength wire rods of Comparative Example in Table 2 which are denoted by the open diamond symbol (◇), area fraction of pro-eutectoid ferrite had a value greater than 3%.

Inventive Steels Numbers. 1 to 15 satisfied the requirements that the B content be in the range of 0.0009 to 0.0060% and that the time period from finishing coiling to starting the patenting treatment be not greater than $t1=0.0008\times(Tr-815)^2+4\times(B\ content-0.0003)/(N\ content-Ti\ content/3.41-B\ content+0.0003)$. Therefore, it was possible to ensure the solid-solubilized B in an amount of 0.0002% or more, and the area fraction of the pro-eutectoid ferrite in the section ranging from the surface layer of the wire rod to the central portion thereof was 3% or less.

Figure 3:
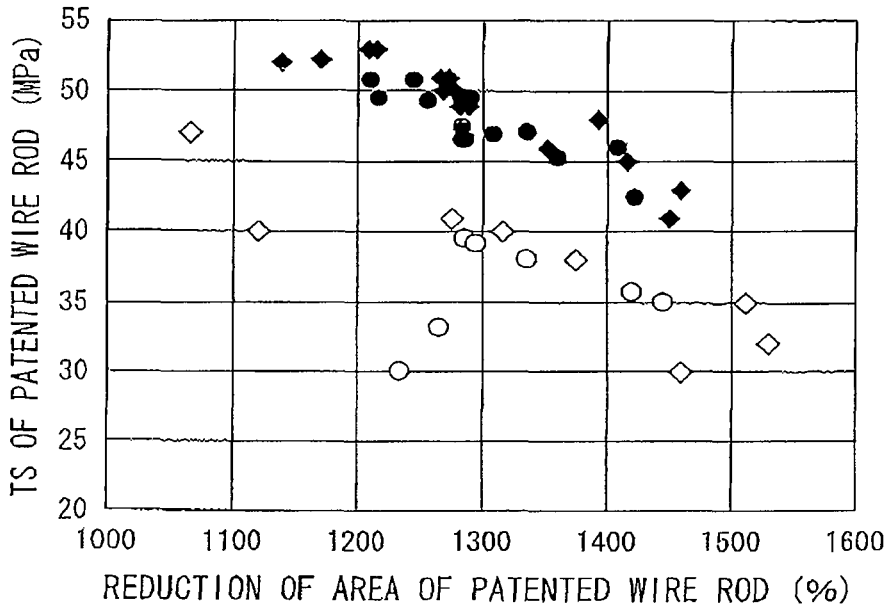
FIG. 3 is a graph showing a relation between a tensile strength TS and a reduction of area in wire rods after a patenting treatment. From the graph of FIG. 3, it is obvious that under the same tensile strength TS, the high strength wire rods of the present invention denoted by solid diamonds ♦ showing values in Table 2 and solid circles ● showing values in Table 4 respectively have a reduction of area that is superior to that of the conventional high strength wire rod of Comparative Example open diamonds ◇ showing values in Table 2 and open circles ○ showing values in Table 4.

FIG. 3 is a graph showing the relation between the tensile strength TS of the wire rod after the patenting treatment and the reduction of area. The solid diamonds ♦ denote Inventive Steels shown in Table 2 and the open diamonds ◇ denote the Comparative Steels shown in Table 2. From the graph, it can be understood that the reduction of area was improved in the wire rods developed according to the present invention.

The strength of the patented wire rod (patented wire strength in Table 2) was also higher than the strength (TS threshold in Table 2) as specified by TS=[1000×C content (%)−10×wire-diameter (mm)+320].

On the other hand, in the wire rod of Comparative Steel No. 31, the temperature of coiling was as low as 750° C. and carbides of B were precipitated before the patenting treatment. Therefore, the formation of pro-eutectoid ferrite could not be suppressed.

In the wire rod of Comparative Steel Nos. 37, 38, and 43, the time from the finishing coiling to starting the patenting treatment was greater than $t1=0.0008\times(Tr-815)^2+4\times(B\ content-0.0003)/(N\ content-Ti\ content/3.41-B\ content+0.0003)$, and thus it was difficult to ensure the amount of the solid-solubilized B. Therefore, the formation of the pro-eutectoid ferrite could not be suppressed.

In the wire rods of Comparative Steel Nos. 33 and 42, the B content was much higher than a predetermined amount, and thus carbides of B and pro-eutectoid cementite were precipitated.

In the wire rod of Comparative Steel No. 34, the Si content was too high at 1.6%, and thus the formation of the pro-eutectoid ferrite could not be suppressed.

In the wire rod of Comparative Steel No. 35, the C content was too high at 1.3%, and thus the formation of pro-eutectoid cementite could not be suppressed.

In the wire rod of Comparative Steel No. 36, the Mn content was too high at 1.5%, and thus the formation of micro-martensite could not be suppressed.

In the wire rods of Comparative Steel Nos. 39 and 40, the cooling rate during the patenting treatment was smaller than the specified rate, and thus it was difficult to obtain a desirable tensile strength in a certain LP (lead patented) material even after the drawing process.

In the wire rods of Comparative Steel Nos. 32, 41, and 44, the B content was lower than a specified amount, and thus the formation of pro-eutectoid ferrite could not be suppressed. The area fraction was greater than 3%.

In Tables 3 and 4, numbers 16 to 30 correspond to the high strength wire rod according to the present invention (Inventive Steel) and numbers 45 to 55 correspond to the conventional wire rods (Comparative Steel).

FIG. 2 is a graph showing a relation between a diameter of a wire rod and an area fraction of pro-eutectoid ferrite in a section extending from the surface of the wire rod to the central portion thereof for each of wire rods after patenting treatments.

Each of the high strength wire rods according to the present invention in Table 4 which are denoted by the solid circles ● stably had an area fraction of pro-eutectoid ferrite of 3% or less regardless of the wire diameter. On the other hand, in each of the conventional high strength wire rods of Comparative Example in Table 4 which is denoted by open circles ○, the pro-eutectoid ferrite respectively had an area fraction greater than 3%.

Inventive Steel Nos. 16 to 30 satisfied the requirements that the B content be in the range of 0.0009 to 0.0060% and that the time from finishing coiling to starting patenting treatment be not greater than $t1=0.0008\times(Tr-815)^2+4\times(B\ content-0.0003)/(N\ content-Ti\ content/3.41-B\ content+0.0003)$. Therefore, it was possible to ensure the solid-solibilized B in an amount of 0.0002% or more, and the area fraction of the pro-eutectoid ferrite in the section ranging from the surface layer of the wire rod to the central portion thereof was 3% or less.

FIG. 3 shows a graph of the relation between the tensile strength TS of the wire rod after the patenting treatment and the reduction of area. The solid circle ● denotes Inventive Steels shown in Table 4 and the open circle ○ denotes the Comparative Steels shown in Table 4. From the graph, it can be understood that the reduction of area was improved in the wire rods developed according to the present invention.

The strength of the patented wire rods (patented wire strength in Table 4) was also higher than the strength (TS threshold in Table 4) as specified by $TS=[1000\times C\ content\ (\%)-10\times wire\text{-}diameter\ (mm)+320]$.

On the other hand, in the wire rod of Comparative Steel No. 45, the rolling temperature was low at 750° C. and carbides of B were precipitated before the patenting treatment. Therefore, the formation of pro-eutectoid ferrite could not be suppressed.

In the wire rods of Comparative Steel Nos. 50, 52, 53, and 54, the time from finishing coiling to starting the patenting treatment was greater than $t1=0.0008\times(Tr-815)^2+4\times(B\ content-0.0003)/(N\ content-Ti\ content/3.41-B\ content+0.0003)$, and thus it was difficult to ensure the amount of the solid-solubilized B. Therefore, the formation of the pro-eutectoid ferrite could not be suppressed. The area fraction was 3% or less.

In the wire rod of Comparative Steel No. 46, the B content was much higher than a predetermined amount, and thus carbides of B and the pro-eutectoid cementites were precipitated.

In the wire rod of Comparative Steel No. 47, the Si content was too high at 1.6%, and thus the formation of the pro-eutectoid ferrite structure could not be suppressed.

In the wire rod of Comparative Steel No. 48, the Mn content was too high at 1.5%, and thus it was difficult to suppress the formation of the micro-martensites.

In the wire rod of Comparative Steel Nos. 49, 51, and 55, the B content was lower than a specified amount, and thus it was difficult to suppress the formation of the pro-eutectoid ferrite. The area fraction was greater than 3%.

When steel wires for PWS having a diameter of 5.2 mm were produced as trial products using Inventive Steel Nos. 19, 21, and 26 prepared in the Example, it was possible to produce delamination-free steel wires respectively having a tensile strength TS of 1932 MPa, 1930 MPa, and 1910 MPa. On the other hand, when a steel wire of similar configuration was produced using Comparative Steel No. 54, the tensile strength TS was 2010 MPa, and delamination occurred.

INDUSTRIAL APPLICABILITY

In the present invention having the above-described configuration, by specifying the component composition of the steel wire used and including solid-solubilized B in an amount corresponding to the content of C and Si in austenite before subjecting to a patenting treatment, it is possible to provide a balanced driving force to the cementite precipitation and the ferrite generation and thus to suppress the formation of pro-eutectoid ferrite. Accordingly, it is possible to improve ductility of a wire rod and to prevent breakage during a drawing process, thereby improving the productivity or yield of the wire rod.

A hard steel wire can be obtained having a structure mainly composed of pearlites wherein the average area fraction of the pro-eutectoid ferrite is 3% or less. Accordingly, it is possible to improve performance when used for PC steel wires, galvanized stranded steel wires, spring steel wires, suspension bridge cables and the like.

The invention claimed is:

1. A high strength wire rod which is subjected to a patenting treatment directly after performing a hot-rolling procedure, comprising:

one or more portion having a component composition including, in mass %, C: 0.7 to 1.2%, Si: 0.6 to 1.5%, Mn: 0.1 to 1.0%, N: 0.001 to 0.006%, Al: 0.028 to 0.1%, and B: 0.0009 to 0.0060%, wherein a solid-solubilized amount of B is 0.0002% to 0.0060%; and a balance includes Fe and inevitable impurities, and wherein:

a tensile strength TS (MPa) of the wire rod is specified by the following formula:

$$TS>(1000\times C\ content\ (\%)-10\times wire\text{-}diameter\ (mm)+320);$$

a diameter of the wire rod is 5.0 mm to 18 mm, an area fraction of a pro-eutectoid ferrite is at most 3%, an area fraction of a pearlite structure in the wire rod is 90% or more, and a reduction of an area after breaking of the wire rod is 40% or more with the tensile strength of the wire rod of 1140 MPa or more.

2. The high strength wire rod according to claim 1, wherein the component composition further includes, in mass, Ti: 0.005 to 0.1%.

3. The high strength wire rod according to claim 1, wherein the component composition further includes one or more of, in mass %, Cr: 0.5% or less and excluding 0%, Ni: 0.5% or less and excluding 0%, Co: 0.5% or less and excluding 0%, V: 0.5% or less and excluding 0%, Cu: 0.2% or less and excluding 0%, Mo: 0.2% or less and excluding 0%, W: 0.2% or less and excluding 0%, or Nb: 0.1% or less and excluding 0%.

4. The high strength wire rod according to claim 3, wherein the component composition further includes, in mass, Ti: 0.005 to 0.1%.

5. A high strength wire rod which is subjected to a patenting treatment directly after performing a hot-rolling procedure, comprising:

one or more portion with a component composition including, in mass %, C: 0.7 to 1.2%, Si: 0.6 to 1.5%, Mn: 0.1 to 1.0%, N: 0.001 to 0.006%, Ti: 0.005 to 0.1%, and B: 0.0009 to 0.0060%, in which Al is not added, wherein a solid-solubilized amount of B is 0.0002% to 0.0060%; and a balance includes Fe and inevitable impurities, and wherein:

a tensile strength TS (MPa) of the wire rod is specified by the following formula:

$$TS>(1000\times C\text{ content }(\%)-10\times\text{wire-diameter (mm)}+320),$$

a diameter of the wire rod is 5.0 mm to 18.0 mm, an area fraction of a pro-eutectoid ferrite is at most 3%, an area fraction of a pearlite structure of the wire rod is 90% or more, and a reduction of an area after breaking of the wire rod is 40% or more with the tensile strength of the wire rod of 1140 MPa or more.

6. The high strength wire rod according to claim 5, wherein the component composition further includes one or more of, in mass %, Cr: 0.5% or less and excluding 0%, Ni: 0.5% or less and excluding 0%, Co: 0.5% or less and excluding 0%, V: 0.5% or less and excluding 0%, Cu: 0.2% or less and excluding 0%, Mo: 0.2% or less and excluding 0%, W: 0.2% or less and excluding 0%, or Nb: 0.1% or less and excluding 0%.

7. A high strength steel wire, comprising:

one or more portion having a component composition including, in mass %, C: 0.7 to 1.2%, Si: 0.6 to 1.5%, Mn: 0.1 to 1.0%, N: 0.001 to 0.006%, Al: 0.028 to 0.1%, and B: 0.0009 to 0.0060%, wherein a solid-solubilized amount of B is 0.0002% to 0.0060%; and a balance includes Fe and inevitable impurities, and wherein:

a tensile strength TS (MPa) of the steel wire is specified by the following formula:

$$TS>(1000\times C\text{ content }(\%)-10\times\text{wire-diameter (mm)}+320);$$

an area fraction of a pro-eutectoid ferrite is at most 3%, an area fraction of a pearlite structure in the steel wire is 90% or more, and the steel wire includes a tensile strength of 1600 MPa or more.

8. The high strength steel wire according to claim 7, wherein the component composition further includes, in mass, Ti: 0.005 to 0.1%.

9. A high strength steel wire, comprising:

one or more portion with a component composition including, in mass %, C: 0.7 to 1.2%, Si: 0.6 to 1.5%, Mn: 0.1 to 1.0%, N: 0.001 to 0.006%, Ti: 0.005 to 0.1%, and B: 0.0009 to 0.0060%, in which Al is not added, wherein a solid-solubilized amount of B is 0.0002% to 0.0060%; and a balance includes Fe and inevitable impurities, and wherein:

a tensile strength TS (MPa) of the steel wire is specified by the following formula:

$$TS>(1000\times C\text{ content }(\%)-10\times\text{wire-diameter (mm)}+320),$$

an area fraction of a pro-eutectoid ferrite is at most 3%, an area fraction of a pearlite structure of the steel wire is 90% or more, and the steel wire includes a tensile strength of 1600 MPa or more.

* * * * *